US005450109A

United States Patent [19]

Hock

[11] Patent Number: 5,450,109

[45] Date of Patent: Sep. 12, 1995

[54] BARRIER ALIGNMENT AND PROCESS MONITOR FOR TIJ PRINTHEADS

[75] Inventor: Scott W. Hock, San Diego, Calif.

[73] Assignee: Hewlett-Packard Company, Palo Alto, Calif.

[21] Appl. No.: 36,302

[22] Filed: Mar. 24, 1993

[51] Int. Cl.[6] ..... B41J 2/16

[52] U.S. Cl. ..... 347/67; 347/44; 347/47; 347/63; 29/890.1; 156/626.1; 356/401; 216/27

[58] Field of Search ..... 346/75, 140 R; 29/890.1; 156/626, 647, 657; 347/19, 44, 47, 61, 63, 64, 67; 356/401

[56] References Cited

U.S. PATENT DOCUMENTS

| | | | |
|---|---|---|---|
| 4,309,816 | 1/1982 | Hull | 356/401 X |
| 4,423,127 | 12/1983 | Fujimura | 356/401 X |
| 4,683,481 | 7/1987 | Johnson | 346/140 R |
| 4,694,308 | 9/1987 | Chan et al. | 346/140 R |
| 4,768,883 | 9/1988 | Waldo et al. | 356/401 X |
| 4,882,595 | 11/1989 | Trueba et al. | 346/140 R |
| 5,237,343 | 8/1993 | Osada | 346/140 R |
| 5,243,755 | 9/1993 | Inaba et al. | 29/890.1 |

*Primary Examiner*—Benjamin R. Fuller
*Assistant Examiner*—John E. Barlow, Jr.

[57] ABSTRACT

A thermal ink jet printhead formed of a silicon substrate, a thin film resistor layer disposed on the silicon substrate, a patterned metallization layer disposed on the thin film resistor layer for defining a plurality of ink firing resistors in the resistor layer, and a barrier layer overlying the resistor layer and the metallization layer and having firing chamber openings formed therein. The metallization layer further includes a reference target pattern, and the barrier layer further includes a reference opening overlying the target reference pattern which is configured such that the alignment of reference opening relative to the target reference is representative of the alignment of the respective firing chamber openings relative to the associated underlying ink firing resistors.

9 Claims, 5 Drawing Sheets

A=B=C=0

A=B=C≠0

A=B=C≠0

A=C=0, B≠0

A=C=0, B≠0

C>A≠0, B≠0

A>C≠0, B≠0

BARRIER ALIGNMENT AND PROCESS MONITOR FOR TIJ PRINTHEADS

BACKGROUND OF THE INVENTION

This invention relates generally to the art and technology of thermal ink jet printing and more particularly to a new and improved thin film resistor (TFR) printhead architecture and geometry which is used in the manufacture of disposable thermal ink jet (TIJ) pens.

In the design of the thin film resistor printheads used in the manufacture of thermal ink jet pens, it has been a common practice to photolithographically define and electrically interconnect a plurality of heater resistors, such as those made of tantalum aluminum, on a thin film substrate and then construct a corresponding plurality of aligned firing chambers and associated orifice openings above and adjacent to the heater resistors. These firing chambers and orifice openings are used in ejecting ink from a region within the firing chambers and above the heater resistors and onto a print medium. As is well known, these firing chambers have commonly been constructed of a selected polymer material disposed on the TFR substrate and on top of which an orifice plate such as a gold plated nickel material is disposed and aligned with respect to the firing chambers. The polymer barrier layer is also photolithographically defined so as to have a predetermined firing chamber geometry and pattern adjacent to which an ink feed channel or port is used to fluidically connect each firing chamber with a source of ink supply.

In operation, electrical drive pulses are selectively applied to conductive traces leading into the various heater resistors situated in the bottom of each firing chamber to thereby heat the ink to boiling in each firing chamber and above each heater resistor. This resistor firing in turn produces a vapor bubble and a corresponding pressure field within the firing chamber used for thermally ejecting ink onto an adjacent print medium.

In one general architecture of firing chambers, the cross-sectional geometry of the firing chambers defined by the walls of the polymer barrier located between the thin film resistor substrate and the orifice plate was partially rectangular in shape and of a three sided wall construction. The firing chambers and ink flow ports connected thereto function not only to define an ink flow path and ink firing chamber for each heater resistor, but this architecture also serves to fluidically isolate adjacent heater resistors and thereby minimize undesirable crosstalk therebetween.

Examples of the above three sided rectangular shaped barrier layer geometries are those used in the three color disposable pen adapted for use in Hewlett Packard's PaintJet thermal ink jet printer. This disposable pen and the PaintJet thermal ink jet printer in which it has been successfully used are described in further detail in the *Hewlett Packard Journal*, Volume 39, No. 4 August 1988, incorporated herein by reference. The general architecture of the orifice plate and ink feed geometry for the above PaintJet pen is also described in U.S. Pat. No. 4,771,295, issued to Jeffrey P. Baker et al., assigned to the present assignee and also incorporated hereby by reference.

The three-sided firing chambers are commonly utilized with rectangularly shaped heating resistors which are typically positioned with their edges within the enclosed region defined by the downward extension of the chamber walls.

Whereas the above Hewlett Packard thermal ink jet pen designs of three-sided barrier layer and firing chamber construction have performed quite satisfactorily under most conditions of operation, there are nevertheless certain situations where the above three-sided rectangular-shaped barrier layer designs have not been totally suitable for producing acceptably uniform ink drop volumes, printed dot and line uniformity and a corresponding acceptable print quality, particularly during sustained high frequency operation of the thermal ink jet pen. It is the solution to this problem to which the present invention is directed.

SUMMARY OF THE INVENTION

In accordance with the present invention, it has been discovered that precise close spacing between (a) the firing chamber center wall that is opposite the chamber opening and (b) the corresponding edge of the underlying heater resistor produces a significant improvement in the uniformity and consistency of ink drop volumes being ejected from these firing chambers and associated orifice openings. This in turn results in a significant improvement in overall print quality. It is believed that the above previously unacceptable variations in printed dot size and corresponding drop volume produced by the earlier described thermal ink jet pens resulted from the fact that residual air from the vaporized fluid unnecessarily accumulated in the gap between the firing chamber center wall the corresponding resistor edge of the earlier designed firing chambers.

When a thermal ink jet drop generator design allows the residual air and gases from previous printing cycles to accumulate adjacent a heater resistor surface, this air and gas will provide low temperature nucleation sites on the heater resistor that will alter the time into the drive pulse width that ink vaporization begins. This alteration in turn will vary the pressure delivered to the ink being ejected from the printhead. Because ink drop volume surging within an ink firing chamber diminishes as the thermal ink jet firing frequency is reduced, it has been concluded that this alteration results from some time dependent process that diminishes after drop ejection, and the re-dissolution process of the residual air left over from the bubble vaporization process is such a time dependent process.

Accordingly, the general purpose and principal object of the present invention is to significantly improve the uniformity of ink drop volumes and corresponding dot and line sizes during thermal ink jet printing in both the text and graphics modes in order to improve the overall print quality of the hardcopy output. This purpose and object are achieved and accomplished by, among other things, providing a visual target which allows for precise determination of the spacing between the edges of the firing resistors and the corresponding edges of the ink firing chambers formed in the barrier layer overlying the thin film resistor substrate.

An orifice plate is disposed on top of the barrier layer and has a corresponding plurality of orifice openings, with one orifice opening being aligned, respectively, with each firing chamber for ejecting uniform-volume ink drops therefrom during an ink jet printing operation.

Another object of this invention is to provide a new and improved thermal ink jet printhead of the type described wherein significant improvements in high frequency performance and resulting print quality can be achieved using as a minimum of process and design modifications to existing thermal ink jet printhead manufacturing processes and TIJ pen designs.

Another object is to provide a new and improved thermal ink jet printhead of the type described wherein the drop ejection stability and drop-to-drop consistency has been significantly improved with respect to known prior art TIJ pen designs.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
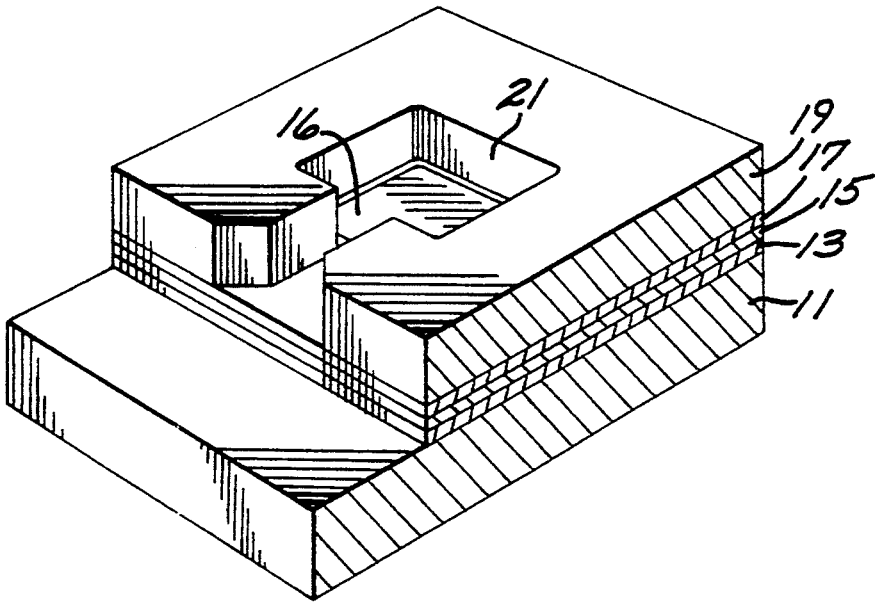
FIG. 1 is a schematic sectional perspective illustrating a portion of a thermal ink jet printhead in which the disclosed invention can be implemented.

In the following detailed description and in the several figures of the drawing, like elements are identified with like reference numerals.

Figure 2:
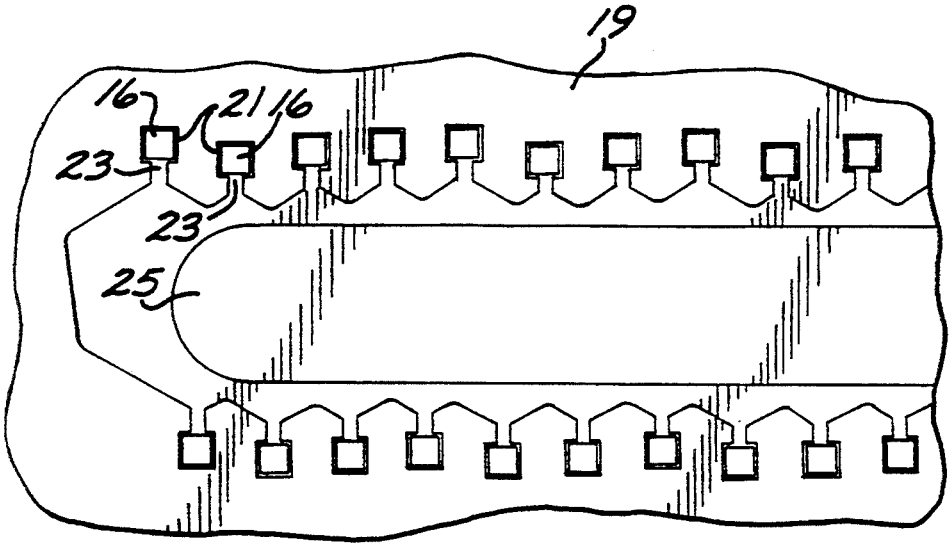
FIG. 2 is a schematic partial top plan view of thermal ink jet printhead of FIG. 1.

Referring now to FIGS. 1 and 2, schematically depicted therein is an implementation of a thermal ink jet printhead in which the disclosed invention can be implemented. The printhead of FIG. 1 includes a silicon substrate 11 having a resistor layer 13 and a metallization layer 15 disposed thereon. In accordance with known techniques, the metallization layer 15 is patterned to include a resistor pattern that defines the dimensions and locations of ink firing resistors 16 in the resistor layer. A passivation layer 17 is disposed over the metallization layer 15, and a polymer barrier layer 19 is disposed over the passivation layer 17. The polymer barrier layer 19 includes a pattern of openings 21 that comprise a plurality of ink firing chambers at locations that overlie the ink firing resistors 16.

The polymer barrier layer 19 can be formed from a polymeric material using known photolithographic masking and etching processes to define the firing chambers 21 which overlie respective ink firing resistors formed in the resistor layer 13. Each firing chamber includes one open side that is connected to an ink feed channel 23 which extends to an ink feed slot 25 that extends through the thin film layers and the silicon substrate 11.

In the complete thermal ink jet printhead, a nozzle plate of conventional construction and fabricated typically of gold plated nickel is disposed on the upper surface of the polymer barrier layer 19, but is not shown for clearer illustration of the invention. Such nozzle plate includes a plurality of ink ejecting nozzles disposed over the ink firing chamber openings 21.

Examples of thermal ink jet printhead construction are shown in the *Hewlett Packard Journal*, Volume 39, No. 4, August 1988, incorporated herein by reference, and also in the *Hewlett Packard Journal*, Volume 36, No. 5, May 1985, also incorporated herein by reference.

Figure 3:
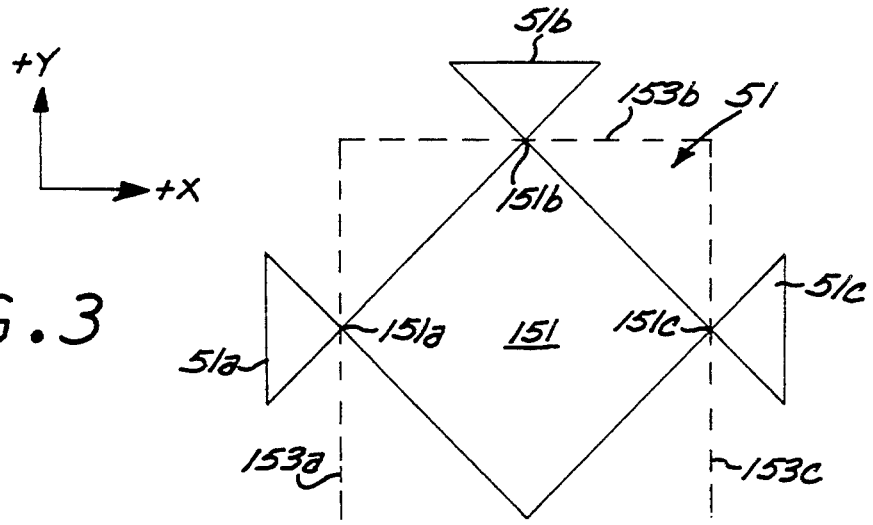
FIG. 3 is a top plan view of a target pattern formed in the metallization layer of the thermal ink jet printhead of FIG. 1 in accordance with the invention.

Referring now to FIG. 3, set forth therein is a top plan view of a reference target pattern 51 that is included in the metallization pattern of the metallization layer 15 in accordance with the invention. Prior to installation of a nozzle plate on the printhead structure of FIG. 1, the reference target 51 is viewable through a target reference opening 53 formed in the barrier layer over the reference target pattern 51, as illustrated in FIGS. 4–14, since the passivation layer 17 is relatively transparent. The pattern of openings in the polymer barrier layer 19, including the firing chamber openings and the reference opening, is made pursuant to a barrier layer mask and the pattern of the metallization layer 15 is made pursuant to one or more of masks, for example. Such masks are designed to produce a metallization layer pattern and a barrier layer pattern that have a fixed geometrical relation relative to each other in two orthogonal dimensions that are parallel to the planar orientation of the top of the printhead, and the reference target 51 is configured to indicate misalignment or improper development of the barrier layer 19 by its relation to the edges of the target reference opening 53. Since the pattern of the metallization layer defines the locations and dimensions of the ink firing resistors and since the pattern of the barrier layer defines the locations of the firing chambers, the alignment of the ink firing resistors relative to the firing chambers can be detected from the relation between the reference target 51 and the reference opening 53.

By way of illustrative example, a reference target and an associated reference opening can be located near one corner of an integrated circuit die in which the printhead is implemented, and another reference target and an associated reference opening can be located near a diametrically opposite corner of the integrated circuit die. In this manner, rotational misalignment can be detected by comparing the targets.

As shown in FIGS. 4–13, the target reference opening 53 can be substantially similar to the firing chamber openings 21, for example, and includes three walls 53*a*, 53*b*, 53*c* that form three sides of a rectangle in plan view. Thus, the walls 53*a*, 53*c* are of the same length and are parallel to each other, while the wall 53*b* can be of a different length and is orthogonal to the walls 53*a*, 53*c*. For ease of reference the walls 53*a*, 53*c* are conveniently called side walls 53*a*, 53*c*, and the wall 53*b* is conveniently called the back wall or the third wall. An ink flow opening is formed opposite the centrally located back wall in accordance with conventional printhead designs.

Referring again in particular to FIG. 3, by way of illustrative example, the reference target 51 comprises a parallelogram shaped central region 151 having four vertexes, three of which are located at the respective centers of imaginary line segments 153*a*, 153*b*, 153*c* that correspond to the desired locations of the three walls 53*a*, 53*b*, 53*c* of the reference opening 53 which is illustrated in FIGS. 4–13. Thus, the angles at the vertexes of the parallelogram shaped central region 151 are centered on lines that are perpendicular to the imaginary line segments 153*a*, 153*b*, 153*c* that correspond to the desired locations of the three walls. The reference target 51 further includes four outboard triangular areas formed by extensions of lines that form the sides of the parallelogram shaped central region. Three of the outboard triangular areas are adjacent the three imaginary line segments 153*a*, 153*b*, 153*c* that underlie and correspond to the desired locations of the walls 53*a*, 53*b*, 53*c* of the reference opening 53, and are respectively identified by the reference numerals 51*a*, 51*b*, 51*c*.

In essence, associated with each of the three walls 53*a*, 53*b*, 53*c* of the reference opening 53 is a sub-pattern that comprises an inboard triangular area and an outboard triangular area having a common vertex, wherein each triangular area is formed by two line segments that cross at the center of the imaginary line segment that corresponds to the desired location of the wall, wherein the smaller included angle formed by a line segment and the imaginary line segment crossed thereby is the same for both line segments. Thus, as to each triangle, the angle between one edge of the triangle and the portion of the wall reference immediately adjacent thereto is equal to the angle between the other edge of the triangle and the portion of the wall reference immediately adjacent thereto. Stated another way, the triangles at each imaginary line segment are oriented such that the line that bisects the included angles of their common vertex is perpendicular to the wall reference segment.

The reference target pattern 51 and the reference opening 53 are generally utilized as follows. An integrated circuit printhead is manufactured at a particular alignment between (a) the metallization masks which define locations of the ink firing resistors 16 and the reference target pattern 51 and (b) the barrier layer mask that defines the firing chamber openings 21 the reference opening 53. The alignment between the reference target pattern 51 and the overlying reference opening 53 is then optically examined, for example by use of a video microscope whose output is provided to a video monitor for analysis by human vision, or whose output is provided to an optical analyzer for analysis by electronic means. As described more fully herein, the particular alignment between the three walls 53*a*, 53*b*, 53*c* of the reference opening 53 and the reference target 51 is indicative of whether the metallization layer mask and the barrier layer mask are properly aligned, the amount of any misalignment, and whether the barrier layer was properly developed.

Referring now to FIGS. 4–13, set forth therein are respective schematic top plan views of the reference target 51 and the overlying reference opening 53 as they would appear for different combinations of alignment and development of the barrier layer. The particular conditions are indicated by the lengths and locations of tell tale line segments A, B, C which are the intersections of the downward projections of the reference opening walls 53*a*, 53*b*, 53*c* onto the target pattern 51. For reference, the direction of any misalignment of the barrier layer will be stated relative to rectilinear coordinate system represented by X and Y axes included in the figures. Generally, the development condition is detected from the locations of the opposite line segments A and C, the X alignment condition is detected from the relative lengths of the opposite line segments A and C, and the Y alignment condition is detected from the location and length of the line segment B as well as from the development condition detected from the locations of the line segments A and C.

Figure 4:
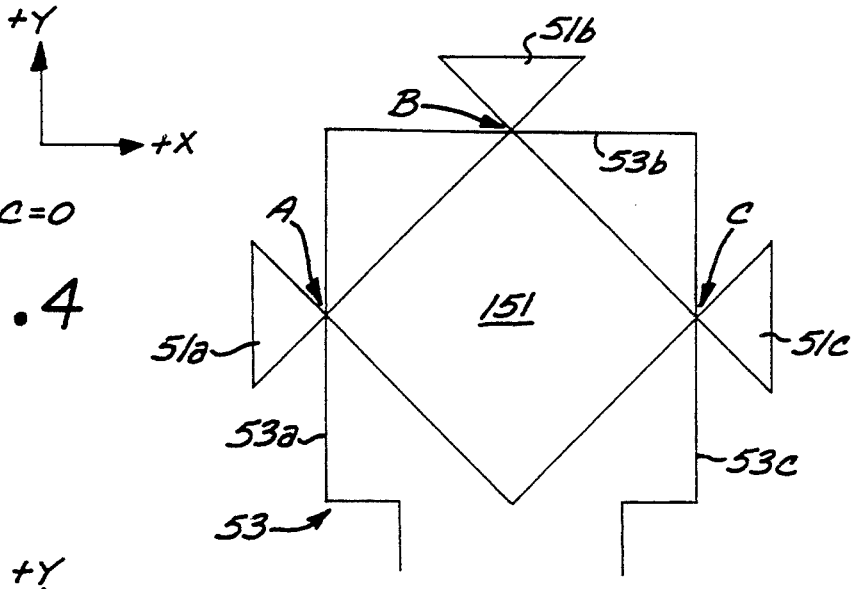
FIG. 4 is a top plan view of the target pattern of FIG. 3 and a reference opening in the barrier layer of the thermal ink jet printhead of FIG. 1 for an example of a particular alignment between the metallization layer and the barrier layer, and a particular development of the barrier layer.

Referring in particular to FIG. 4, the tell tale line segments A, B, C are points on the vertexes 151*a*, 151*b*, 151*c* of the pattern, which indicates proper alignment and proper development of the barrier layer.

Figure 5:
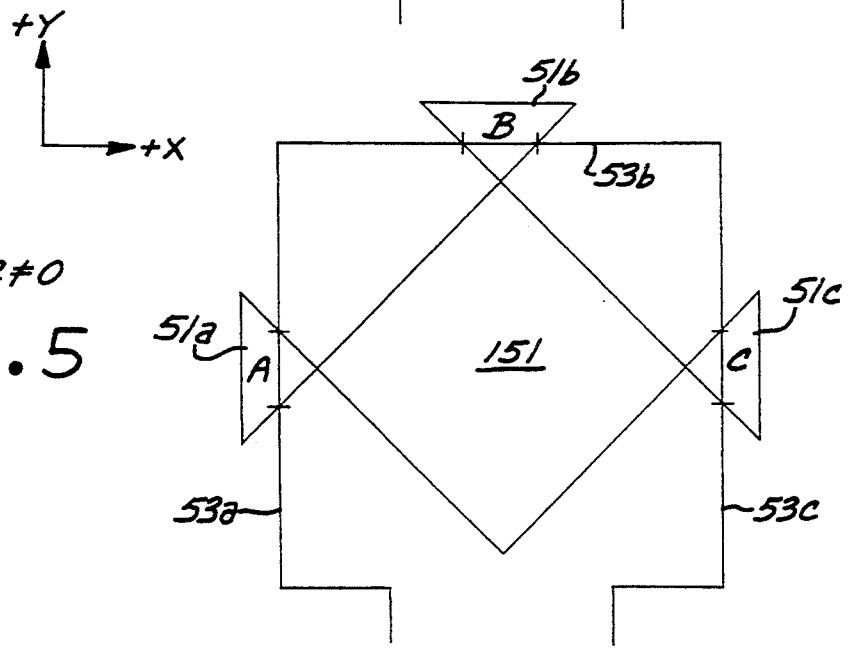
FIG. 5 is a top plan view of the target pattern and the reference opening for another example of alignment and development conditions.

In FIG. 5 the tell tale line segments A, B, C are of equal length and outboard of the vertexes 151*a*, 151*b*, 151*c*. Since the tell tale line segments are of equal length, alignment is indicated to be proper. Since the tell tale line segments are outboard of the vertexes, the barrier layer was overdeveloped; i.e., the openings in the barrier layer were made too large.

Figure 6:
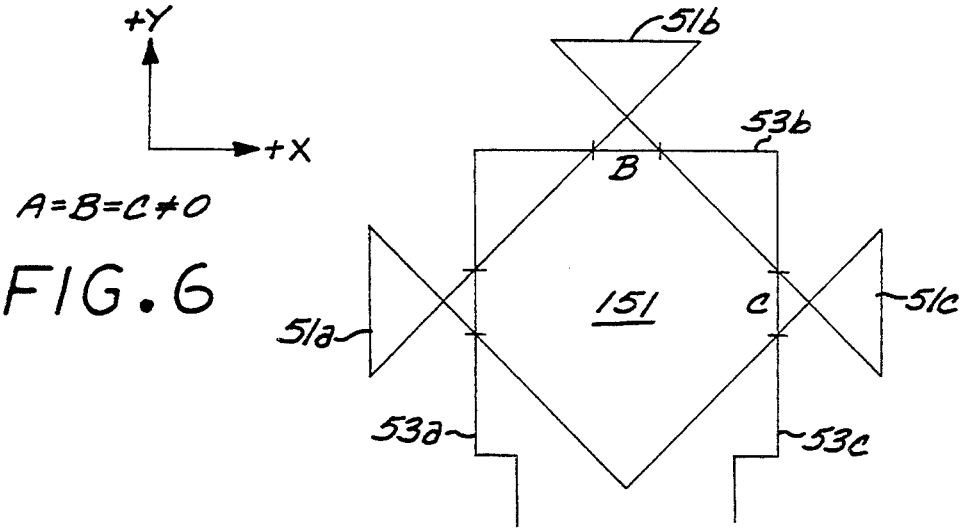
FIG. 6 is a top plan view of the target pattern and the reference opening for yet another example of alignment and development conditions.

In FIG. 6, the tell tale line segments A, B, C are of equal length and inboard of the vertexes 151*a*, 151*b*, 151*c*. Since the tell tale line segments are of equal length, alignment is indicated to be proper. Since the tell tale line segments are inboard of the vertexes, the barrier layer was underdeveloped; i.e., the openings in the barrier layer were made too small.

Figure 7:
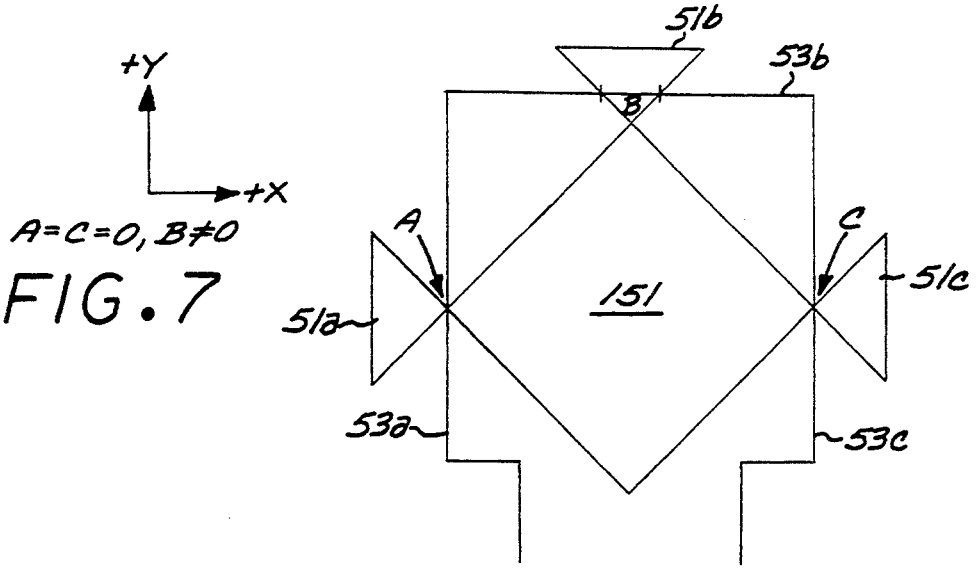
FIG. 7 is a top plan view of the target pattern and the reference opening for a further example of alignment and development conditions.

In FIG. 7, the opposing tell tale line segments A and C are points on the vertexes 151*a* and 151*c*, while the tell tale line segment B is outboard of the vertex 151*b*. Since the tell tale line segments A and C are points on the vertexes 151*a* and 151*c*, proper development is indicated. Since development is proper and the tell tale line segment B is outboard, the barrier layer is misaligned in the +Y direction. In other words, the barrier layer mask needs to moved in the −Y direction relative to the metal masks.

Figure 8:
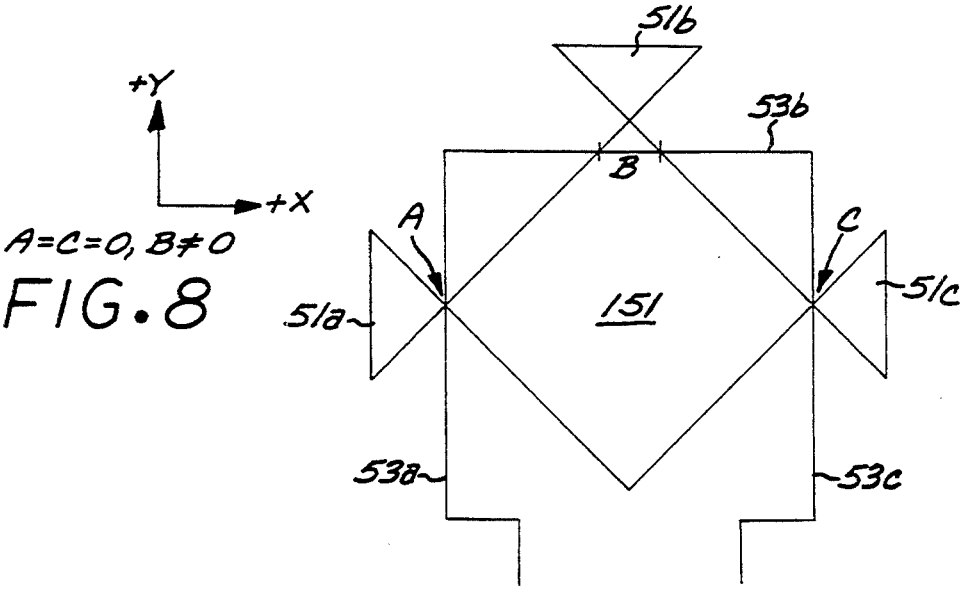
FIG. 8 is a top plan view of the target pattern and the reference opening for another example of alignment and development conditions.

In FIG. 8, the opposing tell tale line segments A and C are points on the vertexes 151*a* and 151*c*, while the tell tale line segment B is inboard of the vertex 151*b*. Since the tell tale line segments A and C are points on the vertexes 151*a* and 151*c*, proper development is indicated. Since development is proper and the tell tale line segment B is inboard, the barrier layer is misaligned in the −Y direction. In other words, the barrier layer mask needs to moved in the +Y direction relative to the metal masks.

Figure 9:
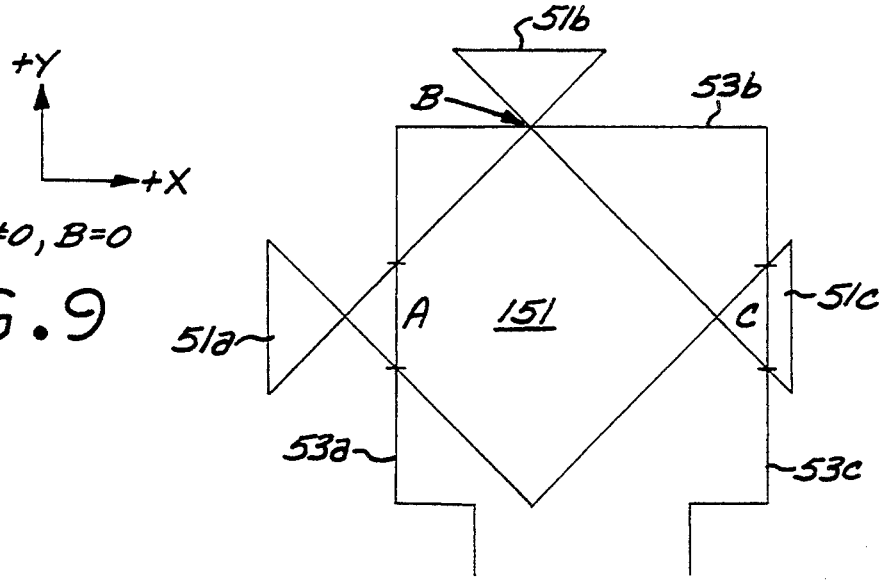
FIG. 9 is a top plan view of the target pattern and the reference opening for yet another example of alignment and development conditions.

In FIG. 9, the tell tale line segment A is inboard of the vertex 151*a*, the tell tale line segment B is a point on the vertex 151*b*, and the tell tale line segment C is outboard of the vertex 151*c* and of the same length as the tell tale line segment A. Since the tell tale line segment A and C are of the same length, development is proper. Since development is proper and the tell tale line segment B is a point on the vertex 151*b*, the barrier layer is misaligned in the +X direction. In other words, the barrier layer mask needs to moved in the −X direction relative to the metal masks.

Figure 10:
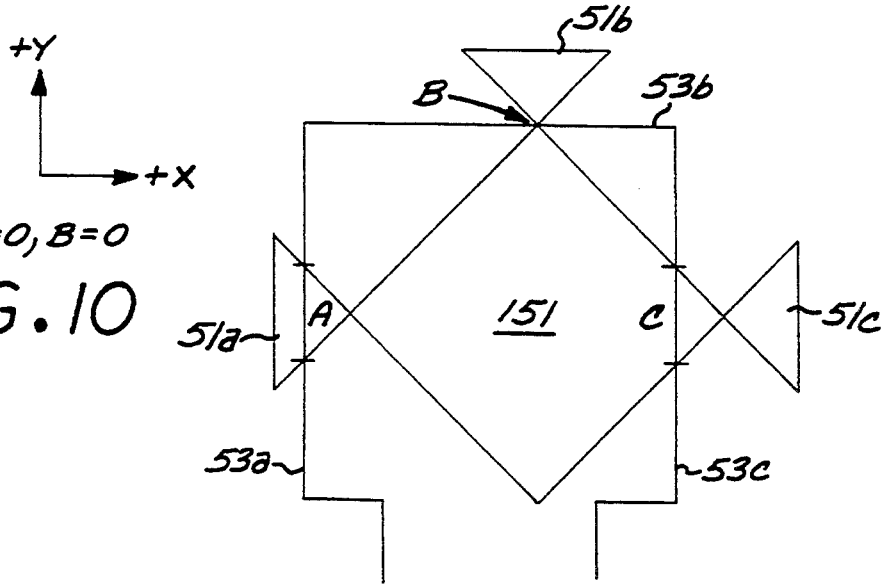
FIG. 10 is a top plan view of the target pattern and the reference opening for still another example of alignment and development conditions.

In FIG. 10, the tell tale line segment A is inboard of the vertex 151*a*, the tell tale line segment B is a point on the vertex 151*b*, and the tell tale line segment C is outboard of the vertex 151*c* and of the same length as the tell tale line segment A. Since the tell tale line segment A and C are of the same length, development is proper. Since development is proper and the tell tale line segment B is a point on the vertex 151*b*, the barrier layer is misaligned in the −X direction. In other words, the barrier layer mask needs to moved in the +X direction relative to the metal masks.

Figure 11:
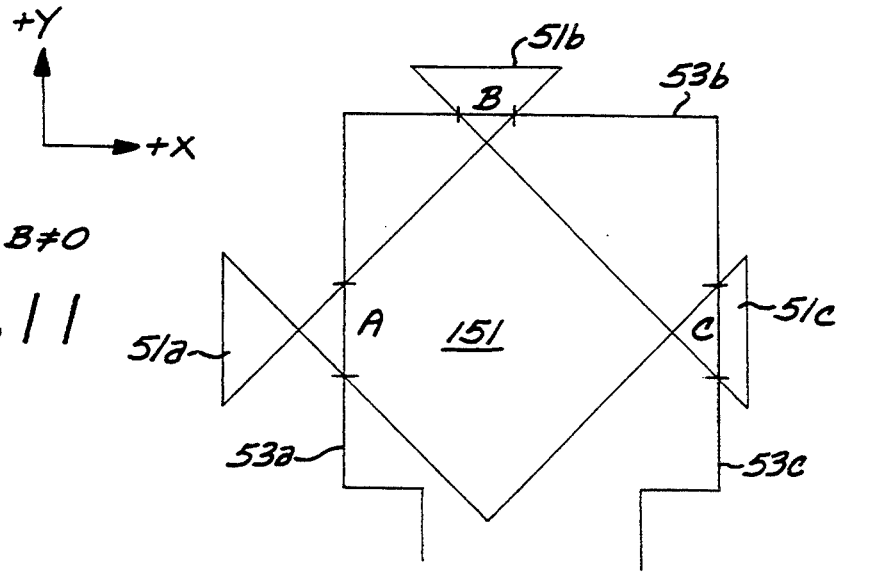
FIG. 11 is a top plan view of the target pattern and the reference opening for a further example of alignment and development conditions.

In FIG. 11, the tell tale line segment A is inboard of the vertex 151*a*, the tell tale line segment B is outboard of the vertex 151*b*, and the tell tale line segment C is outboard of the vertex 151*c* and of the same length as the tell tale line segment A. Since the tell tale line segment A is inboard of the vertex 151*a* and the tell tale line segment B is outboard of the vertex 151*b*, and since the tell tale line segments A and C are of the same length, development is proper. Since development is proper and the tell tale line segment A is inboard of the vertex 151*a*, the barrier layer is misaligned in the +X direction. Since the development is proper and the tell tale line segment B is outboard of the vertex 151*b*, the barrier layer is also misaligned in the +Y direction.

Figure 12:
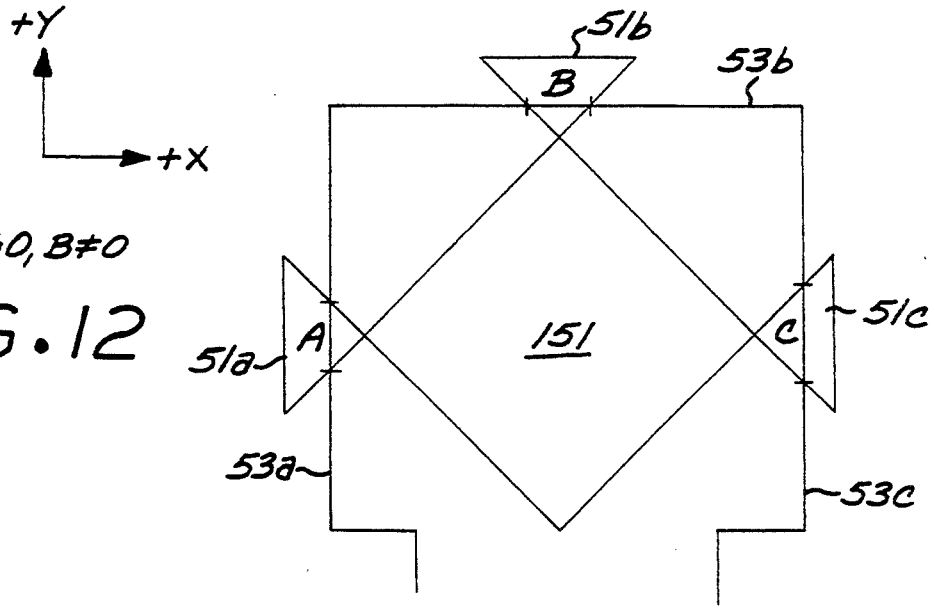
FIG. 12 is a top plan view of the target pattern and the reference opening for another example of alignment and development conditions.

In FIG. 12, the tell tale line segment A is outboard of the vertex 151*a*, the tell tale line segment B is outboard of the vertex 151*b*, and the tell tale line segment C is outboard of the vertex 151*c* and has a greater length than tell tale line segment A. Since the line segments A and C are both outboard of their respective vertexes, the barrier layer is over developed. Since the tell tale line segment C is greater in length than the tell tale line segment A, the barrier layer is misaligned in the +X direction. Whether there is an Y axis misalignment is determined by determining the amount of X axis misalignment, for example by electronically moving the image of edges of the reference opening until the segments A and C equal in length. The amount of overdevelopment can then be calculated from the length of the new segments A and C, and the length of B can be reduced by the amount of overdevelopment to arrive at the Y axis alignment condition.

Figure 13:
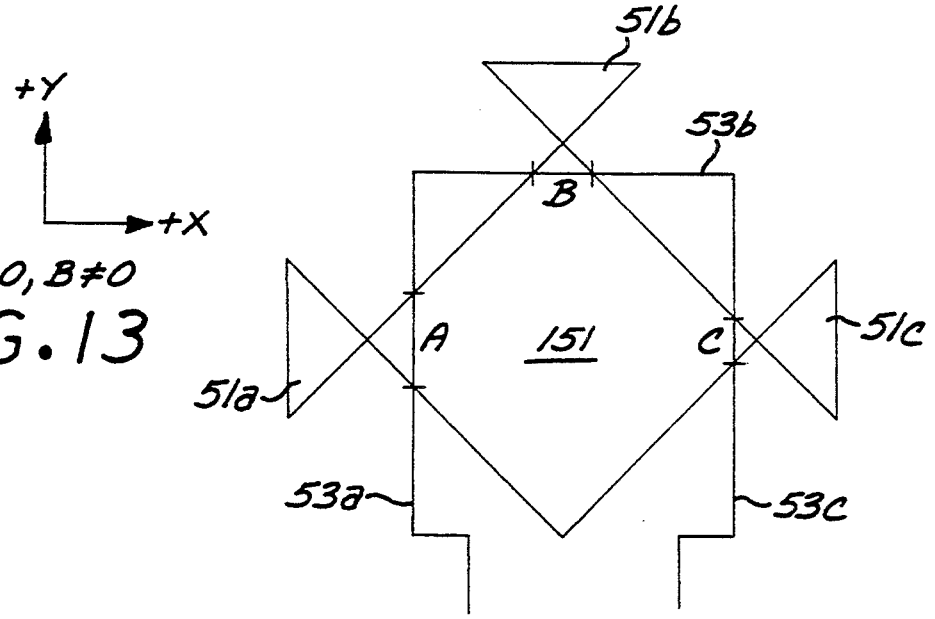
FIG. 13 is a top plan view of the target pattern and the reference opening for a final example of alignment and development conditions.

In FIG. 13, the tell tale line segment A is inboard of the vertex 151*a*, the tell tale line segment B is inboard of the vertex 151*b*, and the tell tale line segment C is inboard of the vertex 151*c* and has a shorter length than tell tale line segment A. Since the line segments A and C are both inboard of their respective vertexes, the barrier layer is under developed. Since the tell tale line segment C is shorter in length than the tell tale line segment A, the barrier layer is misaligned in the −X direction. Whether there is an Y axis misalignment is determined by determining the amount of X axis misalignment, for example by electronically moving the image of edges of the reference opening until the segments A and C equal in length. The amount of under development can then be calculated from the length of the new segments A and C, and the length of B can be reduced by the amount of underdevelopment to arrive at the Y axis alignment condition.

The foregoing has been a disclosure of thermal ink jet printhead that includes a visual target which allows for precise determination of the spacing between the edges of the firing resistors and the corresponding edges of the ink firing chambers formed in the barrier layer overlying the thin film resistor substrate. Pursuant to the precise determination of the spacings between firing resistor edges and ink firing chamber edges, such spacings can be precisely controlled to significantly improve the uniformity of ink drop volumes and corresponding dot and line sizes during thermal ink jet printing in both the text and graphics modes which in turn improves the overall print quality of the hardcopy output.

Although the foregoing has been a description and illustration of specific embodiments of the invention, various modifications and changes thereto can be made by persons skilled in the art without departing from the scope and spirit of the invention as defined by the following claims.

What is claimed is:

1. A thermal ink jet printhead comprising:

a silicon substrate;

a thin film resistor layer disposed on said silicon substrate;

a metallization layer disposed on said thin film resistor layer;

a metallization pattern formed in said metallization layer for defining a plurality of ink firing resistors in said resistor layer and for defining a target pattern in said metallization layer, said plurality of ink firing resistors having locations and dimensions defined by said metallization pattern;

a barrier layer overlying said resistor layer and said metallization layer;

respective firing chamber openings formed in said barrier layer and disposed over each of the ink firing resistors; and a reference opening formed in said barrier layer and disposed over said target pattern, said reference opening having a plurality of connected linear walls which have predetermined intended locations relative to said target pattern;

said target pattern comprised of a plurality of sub-patterns respectively associated with said plurality of connected walls, each sub-pattern comprised of first and second regions that diverge from a common vertex that underlies the predetermined intended location of the associated wall of said reference opening;

whereby the alignment of said reference opening relative to said target is representative of the alignment of said respective firing chamber openings relative to the associated underlying ink firing resistors defined by said metallization pattern in said metallization layer.

2. The thermal ink jet printhead of claim 1 wherein said first and second regions of each sub-pattern each includes linear sides that diverge with distance from their common vertex.

3. The thermal ink jet printhead of claim 1 wherein said first and second regions of each sub-pattern include linear sides formed by line segments that intersect at the common vertex of said first and second regions.

4. The thermal ink jet printhead of claim 1 wherein said vertexes are respectively centered relative to the respective predetermined intended locations of said plurality of connected walls.

5. A thermal ink jet printhead comprising:

a silicon substrate;

a thin film resistor layer disposed on said silicon substrate;

a metallization layer disposed on said thin film resistor layer;

a metallization pattern formed in said metallization layer for defining a plurality of ink firing resistors in said resistor layer and for defining a target pattern in said metallization layer, said plurality of ink firing resistors having locations and dimensions defined by said metallization pattern;

a barrier layer overlying said resistor layer and said metallization layer; and respective firing chamber openings formed in said barrier layer and disposed over each of the ink firing resistors; and a reference opening formed in said barrier layer and disposed over said target pattern, said reference opening having three connected linear walls that form three walls of a rectangle and which have predetermined intended locations relative to said target pattern;

said target pattern comprised of three sub-patterns respectively associated with said three connected walls, each sub-pattern comprised of first and second regions that diverge from a common vertex that underlies the predetermined intended location of the associated wall of said reference opening;

whereby the alignment of said reference opening relative to said target is representative of the alignment of said respective firing chamber openings relative to the associated underlying ink firing resistors defined by said metallization pattern in said metallization layer.

6. The thermal ink jet printhead of claim 5 wherein said first and second regions of each sub-pattern each includes linear sides that diverge with distance from their common vertex.

7. The thermal ink jet printhead of claim 5 wherein said first and second regions of each sub-pattern include linear sides formed by line segments that intersect at the common vertex of said first and second regions.

8. The thermal ink jet printhead of claim 5 wherein said target pattern comprises a parallelogram shaped central region located within said intended locations, and triangular shaped regions outside of said intended locations.

9. The thermal ink jet printhead of claim 5 wherein said vertexes are respectively centered relative to the respective predetermined intended locations of said three connected walls.

* * * * *